US008959866B2

(12) United States Patent
Pervan

(10) Patent No.: US 8,959,866 B2
(45) Date of Patent: Feb. 24, 2015

(54) MECHANICAL LOCKING OF FLOOR PANELS WITH A GLUED TONGUE

(71) Applicant: Valinge Flooring Technology AB, Viken (SE)

(72) Inventor: Darko Pervan, Viken (SE)

(73) Assignee: Valinge Flooring Technology AB, Viken (SE)

( * ) Notice: Subject to any disclaimer, the term of this patent is extended or adjusted under 35 U.S.C. 154(b) by 0 days.

(21) Appl. No.: 14/042,887

(22) Filed: Oct. 1, 2013

(65) Prior Publication Data

US 2014/0033634 A1 Feb. 6, 2014

Related U.S. Application Data

(62) Division of application No. 13/540,107, filed on Jul. 2, 2012, now Pat. No. 8,572,922.

(60) Provisional application No. 61/504,576, filed on Jul. 5, 2011.

(30) Foreign Application Priority Data

| | | |
|---|---|---|
| Jul. 5, 2011 | (SE) | 1150635 |
| Aug. 26, 2011 | (SE) | 1150775 |
| Aug. 29, 2011 | (SE) | 1150777 |

(51) Int. Cl.

| | |
|---|---|
| ***E04B 2/00*** | (2006.01) |
| ***E04F 15/02*** | (2006.01) |
| ***E04F 15/04*** | (2006.01) |

(52) U.S. Cl.

CPC ..... *E04F 15/02038* (2013.01); *E04F 15/02* (2013.01); *E04F 15/04* (2013.01); *E04F 15/02155* (2013.01); *E04F 2015/02077* (2013.01)

USPC ..... 52/582.1

(58) Field of Classification Search

USPC ..... 52/582.1, 582.2, 586.1, 586.2, 585.1, 52/588.1

See application file for complete search history.

(56) References Cited

U.S. PATENT DOCUMENTS

| | | | |
|---|---|---|---|
| 87,853 | A | 3/1869 | Kappes |
| 108,068 | A | 10/1870 | Utley |

(Continued)

FOREIGN PATENT DOCUMENTS

| | | | |
|---|---|---|---|
| CA | 2456513 | A1 | 2/2003 |
| CN | 201588375 | U | 9/2010 |

(Continued)

OTHER PUBLICATIONS

Pervan, Darko, et al., U.S. Appl. No. 14/095,052, entitled "Mechanical Locking of Floor Panels," filed in the U.S. Patent and Trademark Office on Dec. 3, 2013.

(Continued)

*Primary Examiner* — William Gilbert
*Assistant Examiner* — Kyle Walraed-Sullivan
(74) *Attorney, Agent, or Firm* — Buchanan Ingersoll & Rooney P.C.

(57) ABSTRACT

A tongue with edge sections that are used to glue the tongue into a groove of panel. A tongue for connection of a building panel, said tongue is of an elongated shape and made of molded plastic, the tongue including at least two protrusions at a first long edge of the tongue, wherein the protrusions are bendable in a plane parallel to the upper surface of the tongue and extending essentially in the parallel plane and, wherein the tongue has a second long edge, which is essentially straight over substantially the whole length of the tongue and the tongue includes a gluing part configured to be glued into a groove at an edge of the building panel.

13 Claims, 7 Drawing Sheets

(56) References Cited

U.S. PATENT DOCUMENTS

| | | | |
|---|---|---|---|
| 124,228 | A | 3/1872 | Stuart |
| 213,740 | A | 4/1879 | Conner |
| 274,354 | A | 3/1883 | McCarthy et al. |
| 316,176 | A | 4/1885 | Ransom |
| 634,581 | A | 10/1899 | Miller |
| 861,911 | A | 7/1907 | Stewart |
| 1,194,636 | A | 8/1916 | Joy |
| 1,723,306 | A | 8/1929 | Sipe |
| 1,743,492 | A | 1/1930 | Sipe |
| 1,809,393 | A | 6/1931 | Rockwell |
| 1,902,716 | A | 3/1933 | Newton |
| 2,026,511 | A | 12/1935 | Storm |
| 2,204,675 | A | 6/1940 | Grunert |
| 2,266,464 | A | 12/1941 | Kraft |
| 2,277,758 | A | 3/1942 | Hawkins |
| 2,430,200 | A | 11/1947 | Wilson |
| 2,497,837 | A | 2/1950 | Nelson |
| 2,596,280 | A | 5/1952 | Nystrom |
| 2,732,706 | A | 1/1956 | Friedman |
| 2,740,167 | A | 4/1956 | Rowley |
| 2,858,584 | A | 11/1958 | Gaines |
| 2,863,185 | A | 12/1958 | Riedi |
| 2,865,058 | A | 12/1958 | Andersson |
| 2,872,712 | A | 2/1959 | Brown et al. |
| 2,889,016 | A | 6/1959 | Warren |
| 3,023,681 | A | 3/1962 | Worson |
| 3,077,703 | A | 2/1963 | Bergstrom |
| 3,099,110 | A | 7/1963 | Spaight |
| 3,147,522 | A | 9/1964 | Schumm |
| 3,271,787 | A | 9/1966 | Clary |
| 3,325,585 | A | 6/1967 | Brenneman |
| 3,331,180 | A | 7/1967 | Vissing et al. |
| 3,378,958 | A | 4/1968 | Parks et al. |
| 3,396,640 | A | 8/1968 | Fujihara |
| 3,512,324 | A | 5/1970 | Reed |
| 3,517,927 | A | 6/1970 | Kennel |
| 3,526,071 | A | 9/1970 | Watanabe |
| 3,535,844 | A | 10/1970 | Glaros |
| 3,572,224 | A | 3/1971 | Perry |
| 3,579,941 | A | 5/1971 | Tibbals |
| 3,720,027 | A | 3/1973 | Christensen |
| 3,722,379 | A | 3/1973 | Koester |
| 3,742,669 | A | 7/1973 | Mansfeld |
| 3,760,547 | A | 9/1973 | Brenneman |
| 3,760,548 | A | 9/1973 | Sauer et al. |
| 3,778,954 | A | 12/1973 | Meserole |
| 3,849,235 | A | 11/1974 | Gwynne |
| 3,919,820 | A | 11/1975 | Green |
| 3,950,915 | A | 4/1976 | Cole |
| 3,994,609 | A | 11/1976 | Puccio |
| 4,007,994 | A | 2/1977 | Brown |
| 4,030,852 | A | 6/1977 | Hein |
| 4,037,377 | A | 7/1977 | Howell et al. |
| 4,041,665 | A | 8/1977 | de Munck |
| 4,064,571 | A | 12/1977 | Phipps |
| 4,080,086 | A | 3/1978 | Watson |
| 4,082,129 | A | 4/1978 | Morelock |
| 4,100,710 | A | 7/1978 | Kowallik |
| 4,107,892 | A | 8/1978 | Bellem |
| 4,113,399 | A | 9/1978 | Hansen, Sr. et al. |
| 4,169,688 | A | 10/1979 | Toshio |
| 4,196,554 | A | 4/1980 | Anderson |
| 4,227,430 | A | 10/1980 | Jansson et al. |
| 4,299,070 | A | 11/1981 | Oltmanns |
| 4,304,083 | A | 12/1981 | Anderson |
| 4,426,820 | A | 1/1984 | Terbrack |
| 4,447,172 | A | 5/1984 | Galbreath |
| 4,599,841 | A | 7/1986 | Haid |
| 4,648,165 | A | 3/1987 | Whitehorne |
| 5,007,222 | A | 4/1991 | Raymond |
| 5,071,282 | A | 12/1991 | Brown |
| 5,148,850 | A | 9/1992 | Urbanick |
| 5,173,012 | A | 12/1992 | Ortwein et al. |
| 5,182,892 | A | 2/1993 | Chase |
| 5,247,773 | A | 9/1993 | Weir |
| 5,272,850 | A | 12/1993 | Mysliwiec et al. |
| 5,344,700 | A | 9/1994 | McGath et al. |
| 5,348,778 | A | 9/1994 | Knipp et al. |
| 5,373,674 | A | 12/1994 | Winter, IV |
| 5,465,546 | A | 11/1995 | Buse |
| 5,485,702 | A | 1/1996 | Sholton |
| 5,502,939 | A | 4/1996 | Zadok et al. |
| 5,548,937 | A | 8/1996 | Shimonohara |
| 5,598,682 | A | 2/1997 | Haughian |
| 5,618,602 | A | 4/1997 | Nelson |
| 5,634,309 | A | 6/1997 | Polen |
| 5,658,086 | A | 8/1997 | Brokaw et al. |
| 5,671,575 | A | 9/1997 | Wu |
| 5,694,730 | A | 12/1997 | Del Rincon et al. |
| 5,755,068 | A | 5/1998 | Ormiston |
| 5,899,038 | A | 5/1999 | Stroppiana |
| 5,950,389 | A | 9/1999 | Porter |
| 5,970,675 | A | 10/1999 | Schray |
| 6,006,486 | A | 12/1999 | Moriau |
| 6,029,416 | A | 2/2000 | Andersson |
| 6,052,960 | A | 4/2000 | Yonemura |
| 6,065,262 | A | 5/2000 | Motta |
| 6,173,548 | B1 | 1/2001 | Hamar et al. |
| 6,182,410 | B1 | 2/2001 | Pervan |
| 6,216,409 | B1 | 4/2001 | Roy et al. |
| 6,314,701 | B1 | 11/2001 | Meyerson |
| 6,345,481 | B1 | 2/2002 | Nelson |
| 6,363,677 | B1 | 4/2002 | Chen et al. |
| 6,385,936 | B1 | 5/2002 | Schneider |
| 6,418,683 | B1 | 7/2002 | Martensson et al. |
| 6,446,413 | B1 | 9/2002 | Gruber |
| 6,449,918 | B1 | 9/2002 | Nelson |
| 6,490,836 | B1 | 12/2002 | Moriau et al. |
| 6,505,452 | B1 | 1/2003 | Hannig et al. |
| 6,553,724 | B1 | 4/2003 | Bigler |
| 6,591,568 | B1 | 7/2003 | Pålsson |
| 6,601,359 | B2 | 8/2003 | Olofsson |
| 6,617,009 | B1 | 9/2003 | Chen et al. |
| 6,647,689 | B2 | 11/2003 | Pletzer |
| 6,647,690 | B1 | 11/2003 | Martensson |
| 6,651,400 | B1 | 11/2003 | Murphy |
| 6,670,019 | B2 | 12/2003 | Andersson |
| 6,685,391 | B1 | 2/2004 | Gideon |
| 6,763,643 | B1 | 7/2004 | Martensson |
| 6,766,622 | B1 | 7/2004 | Thiers |
| 6,769,219 | B2 | 8/2004 | Schwitte et al. |
| 6,769,835 | B2 | 8/2004 | Stridsman |
| 6,804,926 | B1 | 10/2004 | Eisermann |
| 6,808,777 | B2 | 10/2004 | Andersson et al. |
| 6,854,235 | B2 | 2/2005 | Martensson |
| 6,862,857 | B2 | 3/2005 | Tychsen |
| 6,865,855 | B2 | 3/2005 | Knauseder |
| 6,874,291 | B1 | 4/2005 | Weber |
| 6,880,307 | B2 | 4/2005 | Schwitte et al. |
| 6,948,716 | B2 | 9/2005 | Drouin |
| 7,021,019 | B2 | 4/2006 | Knauseder |
| 7,040,068 | B2 | 5/2006 | Moriau et al. |
| 7,051,486 | B2 | 5/2006 | Pervan |
| 7,108,031 | B1 | 9/2006 | Secrest |
| 7,121,058 | B2 | 10/2006 | Pålsson |
| 7,137,229 | B2 | 11/2006 | Pervan |
| 7,152,383 | B1 | 12/2006 | Wilkinson et al. |
| 7,188,456 | B2 | 3/2007 | Knauseder |
| 7,219,392 | B2 | 5/2007 | Mullet et al. |
| 7,251,916 | B2 | 8/2007 | Konzelmann et al. |
| 7,257,926 | B1 | 8/2007 | Kirby |
| 7,337,588 | B1 | 3/2008 | Moebus |
| 7,377,081 | B2 | 5/2008 | Ruhdorfer |
| 7,451,578 | B2 | 11/2008 | Hannig |
| 7,454,875 | B2 | 11/2008 | Pervan et al. |
| 7,516,588 | B2 | 4/2009 | Pervan |
| 7,517,427 | B2 | 4/2009 | Sjoberg et al. |
| 7,533,500 | B2 | 5/2009 | Morton et al. |
| 7,556,849 | B2 | 7/2009 | Thompson et al. |
| 7,568,322 | B2 | 8/2009 | Pervan |
| 7,584,583 | B2 | 9/2009 | Bergelin et al. |
| 7,614,197 | B2 | 11/2009 | Nelson |
| 7,617,651 | B2 | 11/2009 | Grafenauer |
| 7,621,092 | B2 | 11/2009 | Groeke et al. |

(56) References Cited

U.S. PATENT DOCUMENTS 7,634,884 B2 12/2009 Pervan
7,637,068 B2 12/2009 Pervan
7,654,055 B2 * 2/2010 Ricker ..... 52/592.1
7,677,005 B2 3/2010 Pervan
7,716,889 B2 5/2010 Pervan
7,721,503 B2 5/2010 Pervan et al.
7,726,088 B2 6/2010 Muehlebach
7,757,452 B2 7/2010 Pervan
7,802,411 B2 9/2010 Pervan
7,806,624 B2 10/2010 McLean et al.
7,841,144 B2 11/2010 Pervan et al.
7,841,145 B2 11/2010 Pervan et al.
7,841,150 B2 11/2010 Pervan
7,856,789 B2 12/2010 Eisermann
7,861,482 B2 1/2011 Pervan et al.
7,866,110 B2 1/2011 Pervan
7,908,815 B2 3/2011 Pervan et al.
7,930,862 B2 4/2011 Bergelin et al.
7,980,039 B2 7/2011 Groeke et al.
7,980,041 B2 7/2011 Pervan
8,033,074 B2 10/2011 Pervan
8,042,311 B2 10/2011 Pervan
8,061,104 B2 11/2011 Pervan
8,079,196 B2 12/2011 Pervan
8,112,967 B2 2/2012 Pervan et al.
8,171,692 B2 5/2012 Pervan
8,181,416 B2 5/2012 Pervan et al.
8,191,334 B2 6/2012 Braun
8,234,830 B2 8/2012 Pervan et al.
8,281,549 B2 10/2012 Du
8,302,367 B2 11/2012 Schulte
8,336,272 B2 12/2012 Prager et al.
8,341,914 B2 1/2013 Pervan et al.
8,341,915 B2 1/2013 Pervan et al.
8,353,140 B2 1/2013 Pervan et al.
8,359,805 B2 1/2013 Pervan et al.
8,381,477 B2 2/2013 Pervan et al.
8,387,327 B2 3/2013 Pervan
8,448,402 B2 5/2013 Pervan et al.
8,499,521 B2 8/2013 Pervan et al.
8,505,257 B2 8/2013 Boo et al.
8,511,031 B2 8/2013 Bergelin et al.
8,528,289 B2 9/2013 Pervan et al.
8,544,230 B2 10/2013 Pervan
8,544,234 B2 10/2013 Pervan et al.
8,572,922 B2 11/2013 Pervan
8,578,675 B2 11/2013 Palsson et al.
8,596,013 B2 12/2013 Boo
8,615,952 B2 12/2013 Engström
8,627,862 B2 1/2014 Pervan et al.
8,631,623 B2 1/2014 Engström
8,640,424 B2 2/2014 Pervan et al.
8,650,826 B2 2/2014 Pervan et al.
8,677,714 B2 3/2014 Pervan
8,689,512 B2 4/2014 Pervan
8,707,650 B2 4/2014 Pervan et al.
8,733,065 B2 5/2014 Pervan
8,733,410 B2 5/2014 Pervan
8,763,341 B2 7/2014 Pervan
8,769,905 B2 7/2014 Pervan
8,776,473 B2 7/2014 Pervan et al.
2001/0024707 A1 9/2001 Andersson et al.
2002/0031646 A1 3/2002 Chen et al.
2002/0046433 A1 4/2002 Sellman, Jr. et al.
2002/0069611 A1 6/2002 Leopolder
2002/0092263 A1 7/2002 Schulte
2002/0100231 A1 8/2002 Miller et al.
2002/0170258 A1 11/2002 Schwitte et al.
2002/0170259 A1 11/2002 Ferris
2002/0178674 A1 12/2002 Pervan
2002/0178680 A1 12/2002 Martensson
2003/0009971 A1 1/2003 Palmberg
2003/0024199 A1 2/2003 Pervan et al.
2003/0037504 A1 2/2003 Schwitte et al.
2003/0084636 A1 5/2003 Pervan
2003/0094230 A1 5/2003 Sjoberg
2003/0101681 A1 6/2003 Tychsen
2003/0145549 A1 8/2003 Palsson et al.
2003/0154676 A1 8/2003 Schwartz
2003/0180091 A1 9/2003 Stridsman
2003/0188504 A1 10/2003 Ralf
2003/0196405 A1 10/2003 Pervan
2004/0031227 A1 2/2004 Knauseder
2004/0049999 A1 3/2004 Krieger
2004/0060255 A1 4/2004 Knauseder
2004/0068954 A1 4/2004 Martensson
2004/0107659 A1 6/2004 Glockl
2004/0123548 A1 * 7/2004 Gimpel et al. ..... 52/582.1
2004/0128934 A1 7/2004 Hecht
2004/0139676 A1 7/2004 Knauseder
2004/0139678 A1 7/2004 Pervan
2004/0159066 A1 8/2004 Thiers et al.
2004/0168392 A1 9/2004 Konzelmann et al.
2004/0177584 A1 9/2004 Pervan
2004/0182033 A1 9/2004 Wernersson
2004/0182036 A1 9/2004 Sjoberg et al.
2004/0200175 A1 10/2004 Weber
2004/0211143 A1 10/2004 Hannig
2004/0244325 A1 * 12/2004 Nelson ..... 52/582.1
2004/0250492 A1 12/2004 Becker
2004/0255541 A1 12/2004 Thiers
2004/0261348 A1 12/2004 Vulin
2005/0003132 A1 1/2005 Blix et al.
2005/0028474 A1 2/2005 Kim
2005/0050827 A1 3/2005 Schitter
2005/0138881 A1 6/2005 Pervan
2005/0160694 A1 7/2005 Pervan
2005/0166514 A1 8/2005 Pervan
2005/0205161 A1 9/2005 Lewark
2005/0210810 A1 9/2005 Pervan
2005/0235593 A1 10/2005 Hecht
2006/0053724 A1 3/2006 Braun et al.
2006/0070333 A1 4/2006 Pervan
2006/0099386 A1 5/2006 Smith
2006/0101769 A1 5/2006 Pervan et al.
2006/0156670 A1 7/2006 Knauseder
2006/0236642 A1 10/2006 Pervan
2006/0260254 A1 11/2006 Pervan
2007/0006543 A1 1/2007 Engstrom
2007/0011981 A1 1/2007 Eisermann
2007/0028547 A1 * 2/2007 Grafenauer et al. ..... 52/586.1
2007/0065293 A1 3/2007 Hannig
2007/0108679 A1 5/2007 Grothaus
2007/0151189 A1 7/2007 Yang et al.
2007/0175143 A1 8/2007 Pervan et al.
2007/0175156 A1 8/2007 Pervan et al.
2007/0193178 A1 8/2007 Groeke et al.
2007/0209736 A1 9/2007 Deringor et al.
2007/0214741 A1 9/2007 Llorens Miravet
2008/0000185 A1 1/2008 Duernberger
2008/0000186 A1 1/2008 Pervan et al.
2008/0000187 A1 1/2008 Pervan et al.
2008/0005989 A1 1/2008 Pervan et al.
2008/0010931 A1 1/2008 Pervan et al.
2008/0010937 A1 1/2008 Pervan et al.
2008/0028707 A1 2/2008 Pervan
2008/0034708 A1 2/2008 Pervan
2008/0041008 A1 2/2008 Pervan
2008/0066415 A1 3/2008 Pervan
2008/0104921 A1 5/2008 Pervan et al.
2008/0110125 A1 5/2008 Pervan
2008/0134607 A1 6/2008 Pervan et al.
2008/0134613 A1 6/2008 Pervan
2008/0134614 A1 6/2008 Pervan
2008/0155930 A1 7/2008 Pervan et al.
2008/0172971 A1 7/2008 Pervan
2008/0216434 A1 9/2008 Pervan
2008/0216920 A1 9/2008 Pervan
2008/0236088 A1 10/2008 Hannig et al.
2008/0263975 A1 10/2008 Mead
2008/0295432 A1 12/2008 Pervan et al.
2009/0019806 A1 1/2009 Muehlebach
2009/0100782 A1 4/2009 Groeke et al.
2009/0133353 A1 5/2009 Pervan et al.

(56) References Cited

U.S. PATENT DOCUMENTS

| | | | |
|---|---|---|---|
| 2009/0151290 | A1 | 6/2009 | Liu |
| 2009/0155612 | A1 | 6/2009 | Pervan et al. |
| 2009/0173032 | A1 | 7/2009 | Prager et al. |
| 2009/0193741 | A1 | 8/2009 | Capelle |
| 2009/0193748 | A1 | 8/2009 | Boo et al. |
| 2009/0193753 | A1 | 8/2009 | Schitter |
| 2009/0308014 | A1 | 12/2009 | Muehlebach |
| 2010/0043333 | A1 | 2/2010 | Hannig et al. |
| 2010/0083603 | A1 | 4/2010 | Goodwin |
| 2010/0173122 | A1 | 7/2010 | Susnjara |
| 2010/0281803 | A1 | 11/2010 | Cappelle |
| 2010/0293879 | A1 | 11/2010 | Pervan et al. |
| 2010/0300029 | A1 | 12/2010 | Braun et al. |
| 2010/0300030 | A1 | 12/2010 | Pervan et al. |
| 2010/0300031 | A1 | 12/2010 | Pervan et al. |
| 2010/0319290 | A1 | 12/2010 | Pervan |
| 2010/0319291 | A1 | 12/2010 | Pervan et al. |
| 2011/0016815 | A1 | 1/2011 | Yang |
| 2011/0030303 | A1 | 2/2011 | Pervan et al. |
| 2011/0041996 | A1 | 2/2011 | Pervan |
| 2011/0047922 | A1 | 3/2011 | Fleming, III |
| 2011/0088344 | A1 | 4/2011 | Pervan et al. |
| 2011/0088345 | A1 | 4/2011 | Pervan |
| 2011/0131916 | A1 | 6/2011 | Chen |
| 2011/0154763 | A1 | 6/2011 | Bergelin et al. |
| 2011/0167750 | A1 | 7/2011 | Pervan |
| 2011/0167751 | A1 | 7/2011 | Engstrom |
| 2011/0197535 | A1 | 8/2011 | Baker et al. |
| 2011/0225922 | A1 | 9/2011 | Pervan et al. |
| 2011/0252733 | A1 | 10/2011 | Pervan |
| 2011/0271632 | A1 | 11/2011 | Cappelle et al. |
| 2011/0283650 | A1 | 11/2011 | Pervan et al. |
| 2012/0017533 | A1 | 1/2012 | Pervan et al. |
| 2012/0031029 | A1 | 2/2012 | Pervan et al. |
| 2012/0036804 | A1 | 2/2012 | Pervan |
| 2012/0096801 | A1 | 4/2012 | Cappelle |
| 2012/0124932 | A1 | 5/2012 | Schulte et al. |
| 2012/0151865 | A1 | 6/2012 | Pervan et al. |
| 2012/0174515 | A1 | 7/2012 | Pervan |
| 2012/0174520 | A1 | 7/2012 | Pervan |
| 2012/0174521 | A1 | 7/2012 | Schulte et al. |
| 2012/0192521 | A1 | 8/2012 | Schulte |
| 2012/0279161 | A1 | 11/2012 | Håkansson et al. |
| 2013/0008117 | A1 | 1/2013 | Pervan |
| 2013/0014463 | A1 | 1/2013 | Pervan |
| 2013/0019555 | A1 | 1/2013 | Pervan |
| 2013/0036695 | A1 | 2/2013 | Durnberger |
| 2013/0042562 | A1 | 2/2013 | Pervan |
| 2013/0042563 | A1 | 2/2013 | Pervan |
| 2013/0042564 | A1 | 2/2013 | Pervan |
| 2013/0042565 | A1 | 2/2013 | Pervan |
| 2013/0047536 | A1 | 2/2013 | Pervan |
| 2013/0081349 | A1 | 4/2013 | Pervan et al. |
| 2013/0111845 | A1 | 5/2013 | Pervan |
| 2013/0145708 | A1 | 6/2013 | Pervan |
| 2013/0160390 | A1 | 6/2013 | Stockl |
| 2013/0160391 | A1 | 6/2013 | Pervan et al. |
| 2013/0232905 | A2 | 9/2013 | Pervan |
| 2013/0239508 | A1 | 9/2013 | Darko et al. |
| 2013/0263454 | A1 | 10/2013 | Boo et al. |
| 2013/0263547 | A1 | 10/2013 | Boo |
| 2013/0318906 | A1 | 12/2013 | Pervan et al. |
| 2014/0007539 | A1 | 1/2014 | Pervan et al. |
| 2014/0020324 | A1 | 1/2014 | Pervan |
| 2014/0053497 | A1 | 2/2014 | Pervan et al. |
| 2014/0069043 | A1 | 3/2014 | Pervan |
| 2014/0090335 | A1 | 4/2014 | Pervan et al. |
| 2014/0109501 | A1 | 4/2014 | Darko |
| 2014/0109506 | A1 | 4/2014 | Pervan et al. |
| 2014/0123586 | A1 | 5/2014 | Pervan et al. |
| 2014/0190112 | A1 | 7/2014 | Pervan |

FOREIGN PATENT DOCUMENTS

| | | | |
|---|---|---|---|
| DE | 39 32 980 | A1 | 11/1991 |
| DE | 299 22 649 | U1 | 4/2000 |
| DE | 200 01 788 | U1 | 6/2000 |
| DE | 199 40 837 | A1 | 11/2000 |
| DE | 199 58 225 | A1 | 6/2001 |
| DE | 202 05 774 | U1 | 8/2002 |
| DE | 203 20 799 | U1 | 4/2005 |
| DE | 10 2004 055 951 | A1 | 7/2005 |
| DE | 10 2004 001 363 | A1 | 8/2005 |
| DE | 10 2004 054 368 | A1 | 5/2006 |
| DE | 10 2005 024 366 | A1 | 11/2006 |
| DE | 10 2005 024 184 | A1 | 11/2007 |
| DE | 10 2006 037 614 | B3 | 12/2007 |
| DE | 10 2006 057 491 | A1 | 6/2008 |
| DE | 10 2007 018 309 | A1 | 8/2008 |
| DE | 10 2007 016 533 | A1 | 10/2008 |
| DE | 10 2007 032 885 | A1 | 1/2009 |
| DE | 10 2007 035 648 | A1 | 1/2009 |
| DE | 10 2007 049 792 | A1 | 2/2009 |
| DE | 10 2009 048 050 | B3 | 1/2011 |
| EP | 0 013 852 | A1 | 8/1980 |
| EP | 0 871 156 | A2 | 10/1998 |
| EP | 0 974 713 | A1 | 1/2000 |
| EP | 1 308 577 | A2 | 5/2003 |
| EP | 1 350 904 | A2 | 10/2003 |
| EP | 1 350 904 | A3 | 10/2003 |
| EP | 1 357 239 | A2 | 10/2003 |
| EP | 1 357 239 | A3 | 10/2003 |
| EP | 1 420 125 | A2 | 5/2004 |
| EP | 1 437 457 | A2 | 7/2004 |
| EP | 1 640 530 | A2 | 3/2006 |
| EP | 1 650 375 | A1 | 4/2006 |
| EP | 1 650 375 | A8 | 9/2006 |
| EP | 1 980 683 | A2 | 10/2008 |
| EP | 2 017 403 | A2 | 1/2009 |
| FR | 1.138.595 | | 6/1957 |
| FR | 2 256 807 | | 8/1975 |
| FR | 2 810 060 | A1 | 12/2001 |
| GB | 240629 | | 10/1925 |
| GB | 376352 | | 7/1932 |
| GB | 1171337 | | 11/1969 |
| GB | 2 051 916 | A | 1/1981 |
| JP | 03-110258 | A | 5/1991 |
| JP | 05-018028 | A | 1/1993 |
| JP | 6-288017 | A | 10/1994 |
| JP | 6-306961 | A | 11/1994 |
| JP | 6-322848 | A | 11/1994 |
| JP | 7-300979 | A | 11/1995 |
| JP | 8-086080 | A | 4/1996 |
| WO | WO 94/26999 | A1 | 11/1994 |
| WO | WO 97/47834 | A1 | 12/1997 |
| WO | WO 98/22677 | A1 | 5/1998 |
| WO | WO 00/20705 | A1 | 4/2000 |
| WO | WO 00/43281 | A2 | 7/2000 |
| WO | WO 00/47841 | A1 | 8/2000 |
| WO | WO 00/55067 | A1 | 9/2000 |
| WO | WO 01/02669 | A1 | 1/2001 |
| WO | WO 01/02670 | A1 | 1/2001 |
| WO | WO 01/02671 | A1 | 1/2001 |
| WO | WO 01/02672 | A1 | 1/2001 |
| WO | WO 01/48332 | A1 | 7/2001 |
| WO | WO 01/51732 | A1 | 7/2001 |
| WO | WO 01/51733 | A1 | 7/2001 |
| WO | WO 01/66877 | A1 | 9/2001 |
| WO | WO 01/75247 | A1 | 10/2001 |
| WO | WO 01/77461 | A1 | 10/2001 |
| WO | WO 01/98604 | A1 | 12/2001 |
| WO | WO 02/48127 | | 6/2002 |
| WO | WO 03/012224 | A1 | 2/2003 |
| WO | WO 03/016654 | A1 | 2/2003 |
| WO | WO 03/025307 | A1 | 3/2003 |
| WO | WO 03/074814 | A1 | 9/2003 |
| WO | WO 03/078761 | A1 | 9/2003 |
| WO | WO 03/083234 | A1 | 10/2003 |
| WO | WO 03/087497 | A1 | 10/2003 |
| WO | WO 03/089736 | A1 | 10/2003 |
| WO | WO 2004/016877 | A1 | 2/2004 |

(56) References Cited

FOREIGN PATENT DOCUMENTS

| | | | |
|---|---|---|---|
| WO | WO 2004/020764 | A1 | 3/2004 |
| WO | WO 2004/048716 | A1 | 6/2004 |
| WO | WO 2004/050780 | A2 | 6/2004 |
| WO | WO 2004/053257 | A1 | 6/2004 |
| WO | WO 2004/053257 | A8 | 6/2004 |
| WO | WO 2004/079130 | A1 | 9/2004 |
| WO | WO 2004/083557 | A1 | 9/2004 |
| WO | WO 2004/085765 | A1 | 10/2004 |
| WO | WO 2005/003488 | A1 | 1/2005 |
| WO | WO 2005/054599 | A1 | 6/2005 |
| WO | WO 2006/043893 | A1 | 4/2006 |
| WO | WO 2006/050928 | A1 | 5/2006 |
| WO | WO 2006/104436 | A1 | 10/2006 |
| WO | WO 2006/123988 | A1 | 11/2006 |
| WO | WO 2007/015669 | A2 | 2/2007 |
| WO | WO 2007/079845 | A1 | 7/2007 |
| WO | WO 2007/089186 | A1 | 8/2007 |
| WO | WO 2007/118352 | A1 | 10/2007 |
| WO | WO 2007/141605 | A2 | 12/2007 |
| WO | WO 2007/142589 | A1 | 12/2007 |
| WO | WO 2008/004960 | A2 | 1/2008 |
| WO | WO 2008/004960 | A8 | 1/2008 |
| WO | WO 2008/017281 | A1 | 2/2008 |
| WO | WO 2008/017301 | A2 | 2/2008 |
| WO | WO 2008/017301 | A3 | 2/2008 |
| WO | WO 2008/060232 | A1 | 5/2008 |
| WO | WO 2008/068245 | A1 | 6/2008 |
| WO | WO 2009/116926 | A1 | 9/2009 |
| WO | WO 2010/006684 | A2 | 1/2010 |
| WO | WO 2010/070472 | A2 | 6/2010 |
| WO | WO 2010/070605 | A2 | 6/2010 |
| WO | WO 2010/082171 | A2 | 7/2010 |
| WO | WO 2010/087752 | A1 | 8/2010 |
| WO | WO 2010/108980 | A1 | 9/2010 |
| WO | WO 2010/136171 | A1 | 12/2010 |
| WO | WO 2011/001326 | A2 | 1/2011 |
| WO | WO 2011/012104 | A2 | 2/2011 |
| WO | WO 2011/032540 | A2 | 3/2011 |
| WO | WO 2011/127981 | A1 | 10/2011 |
| WO | WO 2011/151758 | A2 | 12/2011 |

OTHER PUBLICATIONS

Pervan, Darko, et al., U.S. Appl. No. 14/138,330 entitled "Mechanical Locking System for Floor Panels," filed in the U.S. Patent and Trademark Office on Dec. 23, 2013.

Pervan, Darko, U.S. Appl. No. 14/138,385 entitled "Mechanical Locking System for Panels and Method of Installing Same," filed in the U.S. Patent and Trademark Office on Dec. 23, 2013.

Pervan, Darko, et al., U.S. Appl. No. 14/152,402 entitled "Mechanical Locking System for Floor Panels," filed in the U.S. Patent and Trademark Office on Jan. 10, 2014.

Pervan, Darko, et al., U.S. Appl. No. 14/206,286, entitled "Mechanical Locking System for Panels and Method of Installing Same," filed in the U.S. Patent and Trademark Office on Mar. 12, 2014.

Pervan, Darko, U.S. Appl. No. 14/270,711, entitled "Mechanical Locking System for Floor Panels," filed in the U.S. Patent and Trademark Office on May 6, 2014.

Pervan, Darko, et al., U.S. Appl. No. 14/294,230, entitled "Mechanical Locking System for Floor Panels," filed in the U.S. Patent and Trademark Office on Jun. 3, 2014.

Pervan, Darko, U.S. Appl. No. 14/294,623, entitled "Mechanical Locking of Floor Panels with Vertical Folding," filed in the U.S. Patent and Trademark Office on Jun. 3, 2014.

Boo, Christian, U.S. Appl. No. 14/315,879, entitled "Building Panel With a Mechanical Locking System," filed in the U.S. Patent and Trademark Office on Jun. 26, 2014.

Pervan, Darko, et al., U.S. Appl. No. 13/962,446, entitled "Mechanical Locking System for Floor Panels," filed in the U.S. Patent and Trademark Office on Aug. 8, 2013.

Pervan, Darko, U.S. Appl. No. 14/011,042 entitled "Mechanical Locking System for Floor Panels," filed in the U.S. Patent and Trademark Office on Aug. 27, 2013.

Pervan, Darko, U.S. Appl. No. 14/046,235 entitled "Mechanical Locking of Floor Panels with a Flexible Tongue," filed in the U.S. Patent and Trademark Office on Oct. 4, 2013.

Pervan, Darko, U.S. Appl. No. 14/080,105 entitled "Mechanical Locking of Floor Panels with Vertical Folding," filed in the U.S. Patent and Trademark Office on Nov. 14, 2013.

Nygren, Per, et al., U.S. Appl. No. 61/774,749, entitled "Building Panels Provided with a Mechanical Locking System," filed in the U.S. Patent and Trademark Office on Mar. 8, 2013.

International Search Report mailed Nov. 19, 2012 in PCT/SE2012/050764, Swedish Patent Office, Stockholm, Sweden, 9 pages.

Välinge Innovation AB, Technical Disclosure entitled "Mechanical locking for floor panels with a flexible bristle tongue," IP.com No. IPCOM000145262D, Jan. 12, 2007, IP.com PriorArtDatabase, 57 pages.

Engstrand, Ola (Contact)/Välinge Innovation AB, Technical Disclosure entitled "VA-038 Mechanical Locking of Floor Panels With Vertical Folding," IP com No. IPCOM000179246D, Feb. 10, 2009, IP.com Prior Art Database, 59 pages.

Engstrand, Ola (Contact)/Välinge Innovation AB, Technical Disclosure entitled "VA043 5G Linear Slide Tongue," IP com No. IPCOM000179015D, Feb. 4, 2009, IP.com Prior Art Database, 126 pages.

Engstrand, Ola (Owner)/Välinge Innovation AB, Technical Disclosure entitled "VA043b PCT Mechanical Locking of Floor Panels," IP com No. IPCOM000189420D, Nov. 9, 2009, IP.com Prior Art Database, 62 pages.

Engstrand, Ola (Contact)/Välinge Innovation AB, Technical Disclosure entitled "VA055 Mechanical locking system for floor panels," IP com No. IPCOM000206454D, Apr. 27, 2011, IP.com Prior Art Database, 25 pages.

Engstrand, Ola (Contact)/Välinge Innovation AB, Technical Disclosure entitled "VA058 Rocker Tongue," IP com No. IPCOM000203832D, Feb. 4, 2011, IP.com Prior Art Database, 22 pages.

Pervan, Darko (Author)Välinge Flooring Technology, Technical Disclosure entitled "VA066b Glued Tongue," IP com No. IPCOM000210865D, Sep. 13, 2011, IP.com Prior Art Database, 19 pages.

Pervan, Darko (Inventor)Välinge Flooring Technology AB, Technical Disclosure entitled "VA067 Fold Slide Loc," IP com No. IPCOM000208542D, Jul. 12, 2011, IP.com Prior Art Database, 37 pages.

Pervan, Darko (Author)/Välinge Flooring Technology, Technical Disclosure entitled "VA068 Press Lock VFT," IP com No. IPCOM000208854D, Jul. 20, 2011, IP.com Prior Art Database, 25 pages.

Pervan, Darko (Author), Technical Disclosure entitled "VA069 Combi Tongue," IP com No. IPCOM000210866D, Sep. 13, 2011, IP.com Prior Art Database, 41 pages.

Pervan, Darko (Author), Technical Disclosure entitled "VA070 Strip Part," IP com No. IPCOM000210867D, Sep. 13, 2011, IP.com Prior Art Database, 43 pages.

Pervan, Darko (Author), Technical Disclosure entitled "VA071 Pull Lock," IP com No. IPCOM000210868D, Sep. 13, 2011, IP.com Prior Art Database, 22 pages.

Pervan, Darko (Author), Technical Disclosure entitled "VA073a Zip Loc," IP com No. IPCOM000210869D, Sep. 13, 2011, IP.com Prior Art Database, 36 pages.

Pervan, Darko, et al., U.S. Appl. No. 14/463,972, entitled "Mechanical Locking of Floor Panels with a Flexible Bristle Tongue," filed in the U.S. Patent and Trademark Office on Aug. 20, 2014.

Pervan, Darko, et al., U.S. Appl. No. 14/483,352, entitled "Mechanical Locking System for Floor Panels," filed in the U.S. Patent and Trademark Office on Sep. 11, 2014.

Pervan, Darko, U.S. Appl. No. 14/538,223, entitled "Mechanical Locking System for Floor Panels," filed in the U.S. Patent and Trademark Office on Nov. 11, 2014.

* cited by examiner

MECHANICAL LOCKING OF FLOOR PANELS WITH A GLUED TONGUE

CROSS REFERENCE TO RELATED APPLICATIONS

The present application is a divisional of U.S. application Ser. No. 13/540,107, which claims the benefit of U.S. Provisional Application No. 61/504,576, filed on 5 Jul. 2011, Swedish Application No. 1150635-9, filed on 5 Jul. 2011, Swedish Application No. 1150775-3, filed on 26 Aug. 2011, and Swedish Application No. 1150777-9, filed on 29 Aug. 2011. The entire contents of each of U.S. application Ser. No. 13/540,107, U.S. Provisional Application No. 61/504,576, Swedish Application No. 1150635-9, Swedish Application No. 1150775-3, and Swedish Application No. 1150777-9 are hereby incorporated herein by reference in their entirety.

AREA OF INVENTION

The invention generally relates to the field of floor panels with mechanical locking systems with a flexible and displaceable tongue. The invention also relates to a partly bendable tongue for a building panel with such a mechanical locking system.

BACKGROUND OF THE INVENTION

In particular, yet not restrictive manner, the invention concerns a tongue for a floor panel and a set of floor panels mechanically joined to preferably a floating floor. However, the invention is applicable to building panels in general as well. More particularly invention relates to the type of mechanically locking system that comprises a flexible or partly flexible tongue and/or displaceable tongue, in order to facilitate the installation of building panels.

A floor panel of this type is presented in WO 2006/043893, which discloses a floor panel with a locking system comprising a locking element cooperating with a locking groove, for horizontal locking, and a flexible tongue cooperating with a tongue groove, for locking in a vertical direction. The flexible tongue, which may be made of plastic, bends in the horizontal plane and is displaced in a groove during connection of two floor panels. The flexible tongue allows the floor panels to be installed by vertical folding or solely by vertical movement.

The flexible tongues are generally connected into a groove with friction connections. One disadvantage with such connection is that the tongue may fall out from the groove when floor panels swell or shrink or when the groove is not made with sufficient tolerances.

It is known that the tongue may be glued into the groove. The problem is that it is difficult to glue plastic to wood and that part of the glue also glues the tongue in such a way that it cannot be displaced during the connection of the floor panels. The present invention provides a simple way to glue a flexible and displaceable tongue into a groove.

SUMMARY OF THE INVENTION

The aim of present invention is to provide a tongue that is easy to glue in a groove. Useful areas for the invention are floor panels, preferably to be installed floating, of any shape and material e.g. laminate, wood, HDF, veneer or stone. However, the invention is applicable to building panels in general.

The tongue may be used in any mechanical locking system that facilitates the assembling of building panels. The tongue may be used in the mechanical locking system for vertical locking of two adjacent floor panels. The locking system may further comprise additional elements for horizontal locking of the adjacent floor panels.

A first aspect of the invention is a tongue for connection of a building panel, said tongue is of an elongated shape and made of moulded plastic. The tongue comprises protrusions, preferably bow shaped, at a first long edge of the tongue. The protrusions are bendable in a plane parallel to the upper surface of the tongue and extending essentially in the parallel plane. The tongue has a second long edge, which is essentially straight over substantially the whole length of the tongue. The tongue comprises a gluing part configured to be glued into a groove at an edge of the building panel.

The gluing part may be an edge section, which is spaced in the length direction of the tongue from the protrusions.

The edge section may comprise a glue pocket.

The edge section may comprise a flexible link that connects the edge section to the main tongue body.

The tongue may be provided with said edge sections at each edge of the tongue.

The advantage is that the edge sections are spaced from the main tongue body that is displaced during locking. The risk that glue will be applied in the part of the groove where the tongue has to be displaceable is eliminated.

The edge section may be provided with a breaking part, configured to be broken when the tongue is inserted into the groove.

The edge section may be provided with an outer protruding stop part, which overlaps an inner stop part, which protrudes from the edge of the tongue, wherein said inner and outer stop part cooperates to limit the displacement of the tongue in the groove.

The edge section may be provided with a protruding friction connection, configured to hold the tongue in the correct position until the glue is cured.

The gluing part may be a gluing strip extending in the longitudinal direction of the tongue, preferably along substantially the whole length of the tongue, and wherein the gluing strip is attached to the outer end of some of the protrusions.

The advantage with such a gluing strip is that the tongue is attached steady to the groove of the building panel and with an improved position tolerance. It is also easier to provide the glue along the bottom of the groove, which is made possible by this embodiment.

The outer end of the protrusions, at a first edge of the tongue, may be free and not attached to the gluing strip.

The outer end of the protrusions, at a second edge of the tongue, may be attached to the gluing strip.

The outer end of the protrusions may be provided with a thinner section for facilitating the bending of the protrusion.

The outer end of the gluing strip may be provided with a bow shaped part for facilitating the insertion of the tongue into the groove.

There may be an angle between the protrusions and the longitudinal direction of the tongue.

A second aspect of the invention is a building panel provided with a tongue, according to the first aspect, in a sidewardly open groove at edge of the panel.

BRIEF DESCRIPTION OF THE DRAWINGS

The disclosure will in the following be described in connection to exemplary embodiments and in greater detail with reference to the appended exemplary drawings, wherein.

DESCRIPTION OF EMBODIMENTS OF THE INVENTION

Figure 1:
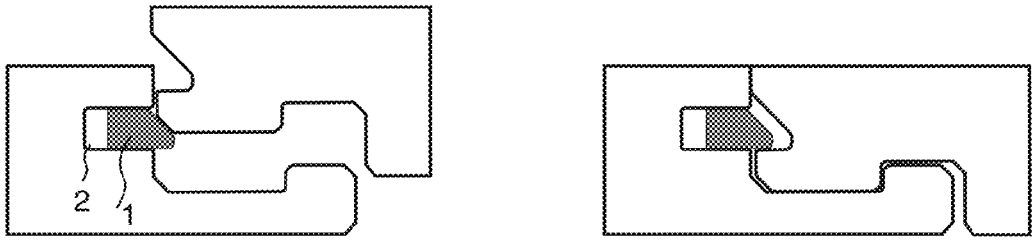
FIG. 1 illustrates a known locking system comprising a displaceable tongue.

FIG. 1 shows a vertical locking of two panels where a flexible and displaceable tongue 1 is displaced in a fixing groove 2.

Figure 2:
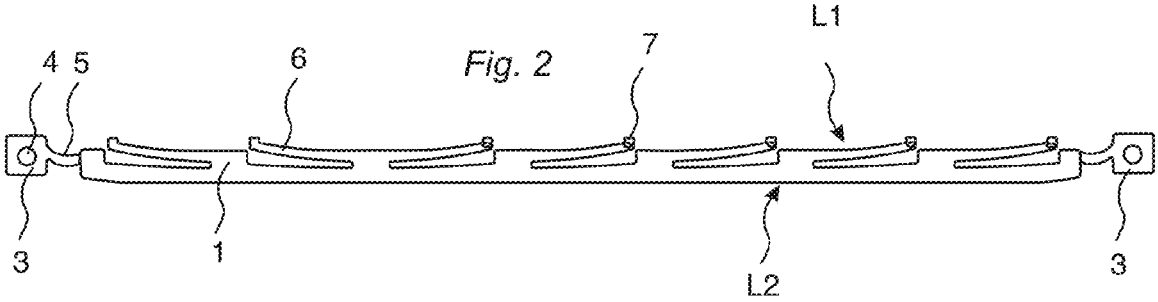
FIG. 2 shows a first embodiment of the tongue according to the invention.

FIG. 2 shows a first embodiment of a flexible tongue 1, made of moulded plastic material, which comprises two edge sections 3, which are intended to be used to glue the tongue into a groove 2.

The tongue is of an elongated shape and comprising in this preferred embodiment at least two protrusions 6 at a first long edge L1.

The protrusions are bendable in a plane parallel to the upper surface of the tongue and extending essentially in the parallel plane.

The tongue has a second long edge L2, which is essentially straight over substantially the whole length of the tongue.

The edge section 3 comprises a glue pocket 4 where glue is applied, preferably by an inserting equipment, which also positions the tongue into a groove of a panel. Friction connections 7 may be used to hold the tongue in the groove until the glue cures.

Figure 3A:
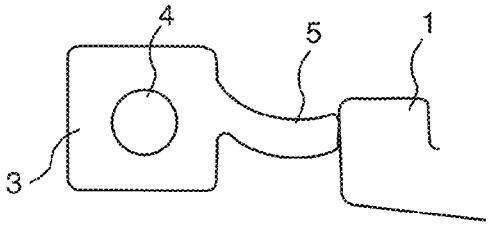
FIGS. 3*a* and 3*b* shows an edge section of the first embodiment of the tongue
Figure 3B:
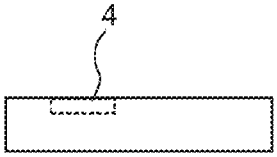

FIG. 3*a* shows the edge section from above. FIG. 3*b* shows a cross section of the edge section. A glue pocket 4 is preferably formed as a local cavity.

The edge section is connected to the main tongue body with a flexible link 5 that allow the tongue to move in the groove 2 and in relation to the edge section 3 that is glued into a groove 2. A wide variety of glues may be used, preferably hot melt based glues.

Figure 4:
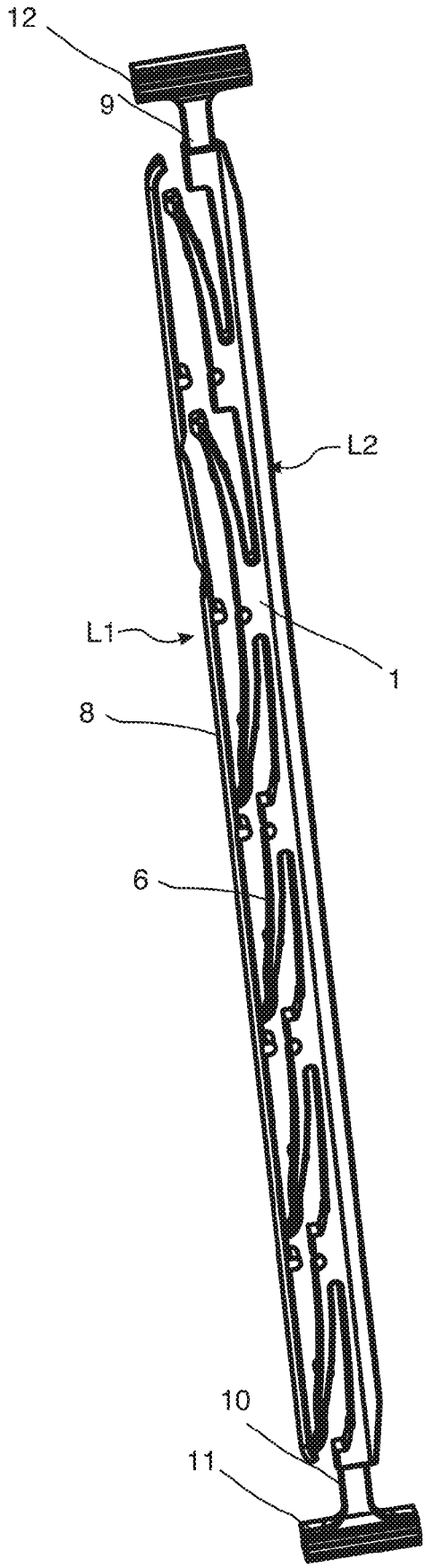
FIG. 4 shows a second embodiment of the tongue.

FIG. 4 shows a second embodiment of a flexible tongue 1, made of moulded plastic material, which is provided with a gluing strip 8 configured to be used to glue the tongue into a groove 2. Parts 11, 12 formed by moulding inlets from a moulding tool are shown at the first 9 and the second edge 10 of the tongue 1. These parts are used to facilitate the insertion of the tongue into a groove 2 of a building panel, preferably a floor panel.

The tongue is of an elongated shape and comprising in the second embodiment at least two protrusions 6 at a first long edge L1.

The protrusions are bendable in a plane parallel to the upper surface of the tongue and extending essentially in the parallel plane.

The tongue has a second long edge L2, which is essentially straight over substantially the whole length of the tongue.

Figure 5:
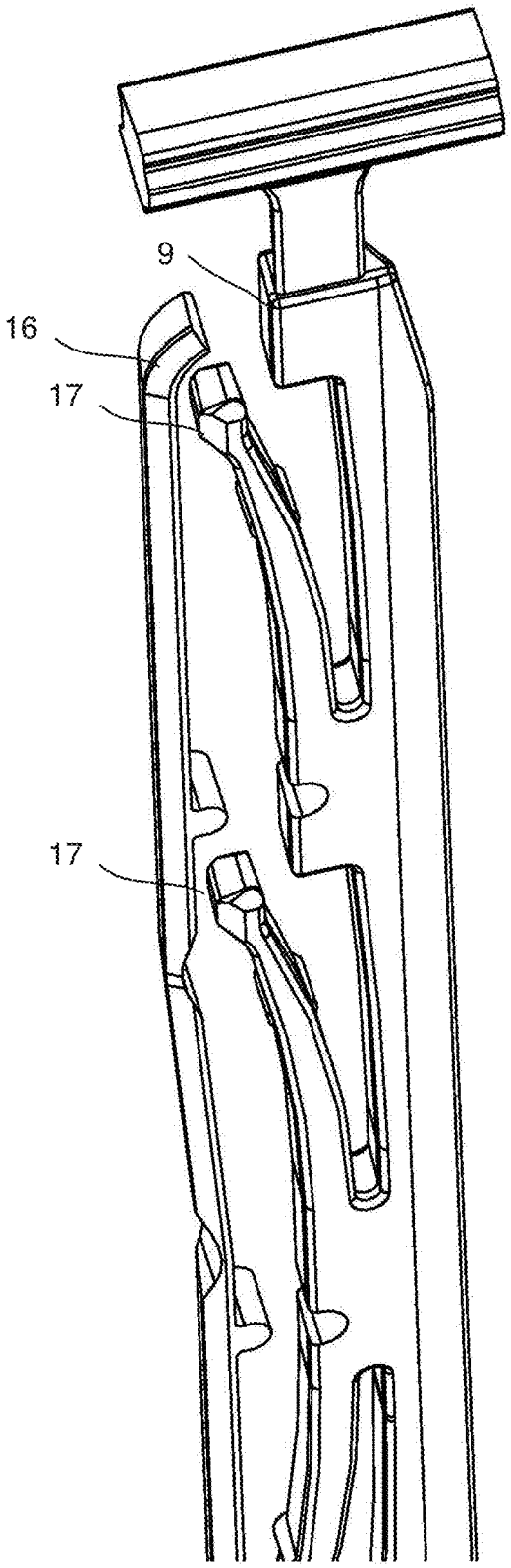
FIG. 5 shows first edge section of the second embodiment.

FIG. 5 shows the first edge 9 of second embodiment of the tongue. The outer ends 17 of the protrusions 6 at the first edge are free from the gluing strip 8 to facilitate a movement of the second long edge L2 along the groove 2 of the building panel. The outer part of the gluing strip is bow shaped 16 to facilitate insertion of the tongue into the groove 2 of the building panel.

Figure 6:
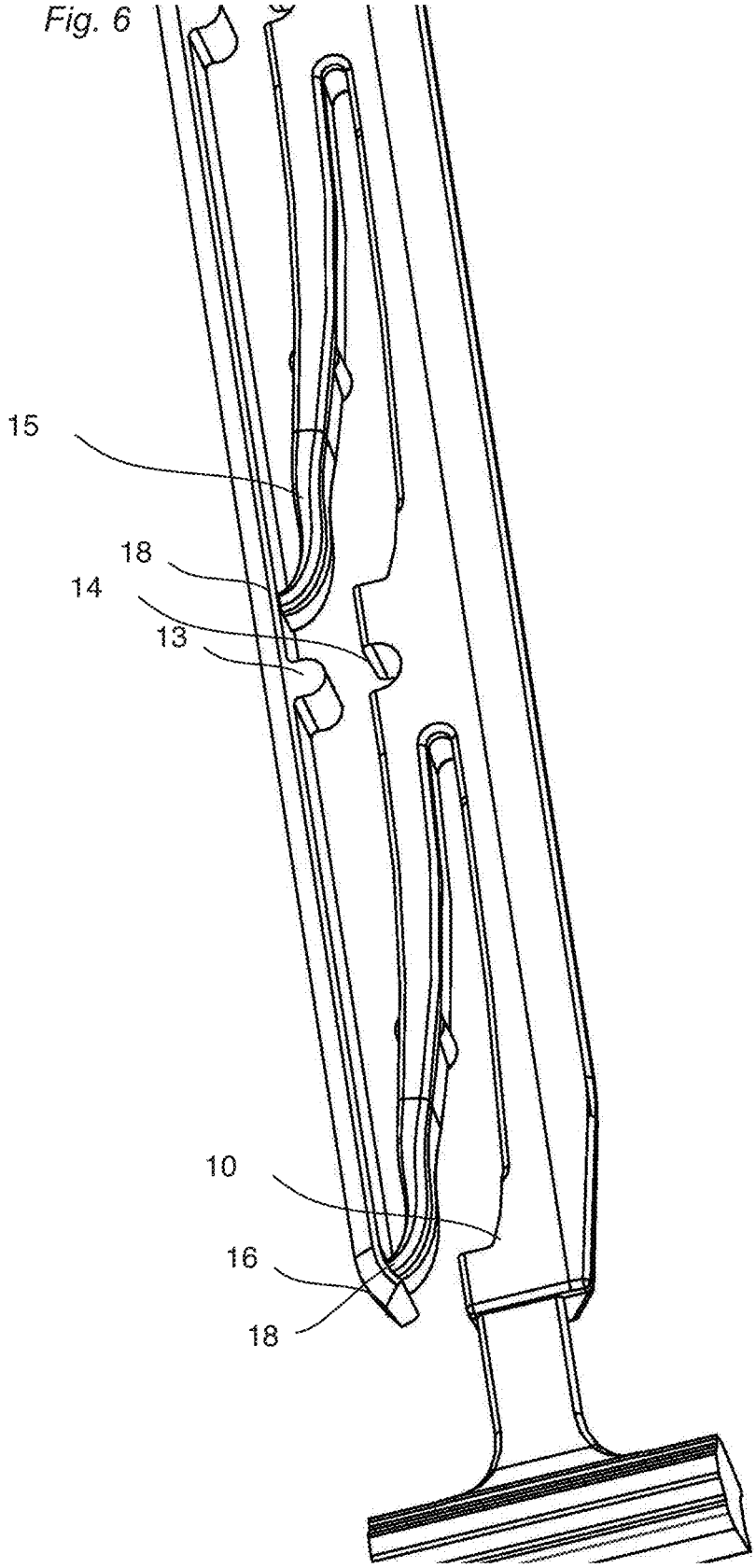
FIG. 6 shows second edge section of the second embodiment.

FIG. 6 shows the second edge 10 of second embodiment of the tongue 1. The outer ends 18 of the protrusions 6 at the second edge are attached to the gluing strip 8. The outer part 16 of the gluing strip is bow shaped to facilitate insertion of the tongue into the groove 2 of the building panel.

The outer ends of the protrusions are provided with a thinner section 15 to improve the bending of the tongue.

The gluing strip is provided with a protrusion 13, which makes it easier to remove the tongue from the moulding tool. The tongue body is provided with an aperture 14 adapted to the size of the gluing strip protrusion 13, which make it possible to push the second long edge L2 of the tongue 1 further into the groove 2 of the building panel.

Figure 7:
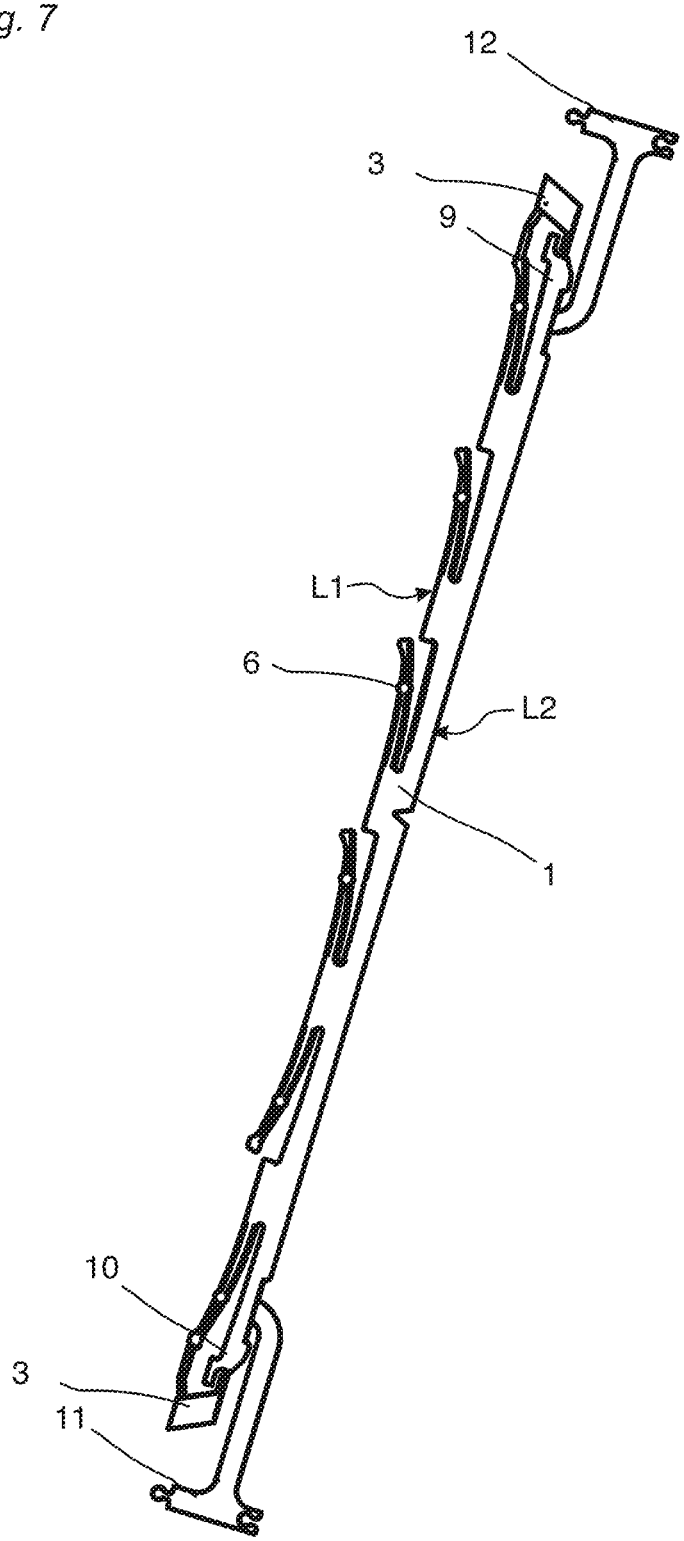
FIG. 7 shows a third embodiment of the tongue.

FIG. 7 shows a third embodiment of a flexible tongue 1, made of moulded plastic material, which is provided with an edge sections 3 configured to be used to glue the tongue into a groove 2. The tongue has a second long edge L2, which is essentially straight over substantially the whole length of the tongue. The tongue is of an elongated shape and comprising in the second embodiment at least two protrusions 6 at a first long edge L1.

Parts 11, 12 formed by moulding inlets from a moulding tool are shown at the first 9 and the second edge 10 of the tongue 1. These parts are used to facilitate the insertion of the tongue into a groove 2 of a building panel, preferably a floor panel.

The protrusions are bendable in a plane parallel to the upper surface of the tongue and extending essentially in the parallel plane.

Figure 8:
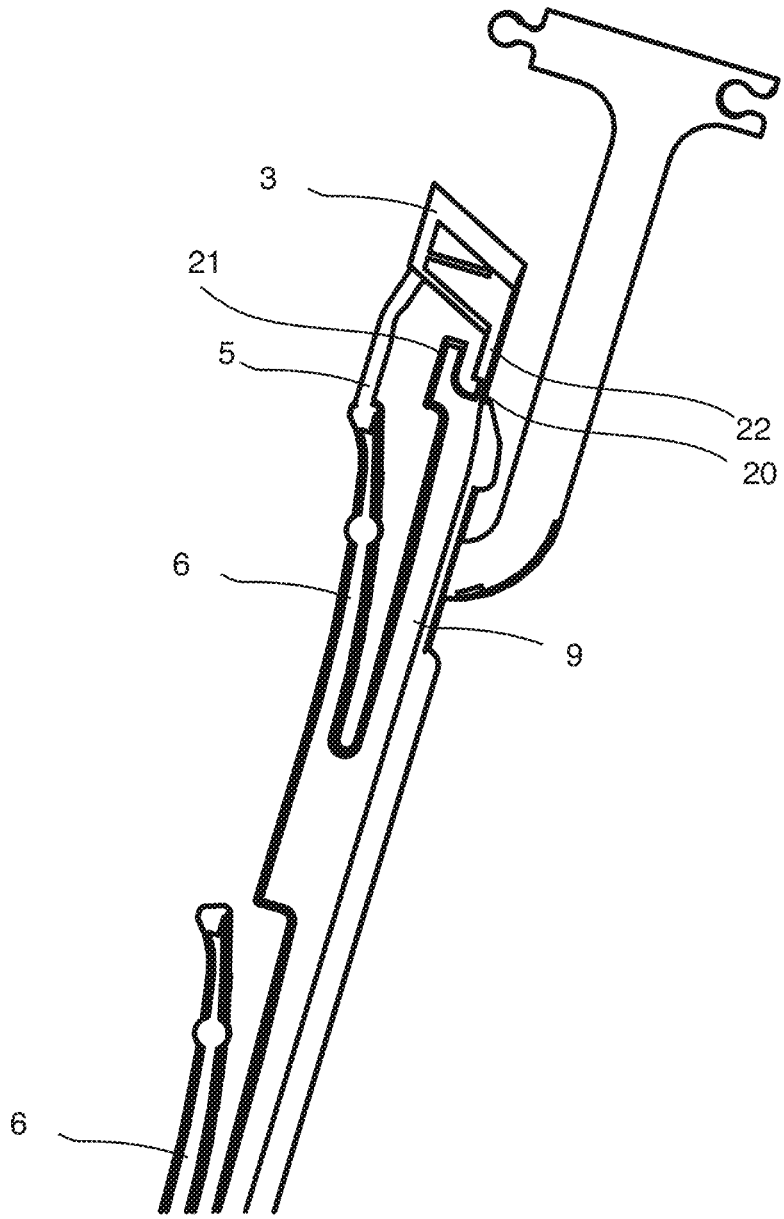
FIG. 8 shows first edge section of the third embodiment.

FIG. 8 shows the first edge 9 of the third embodiment of the tongue.

Figure 9:
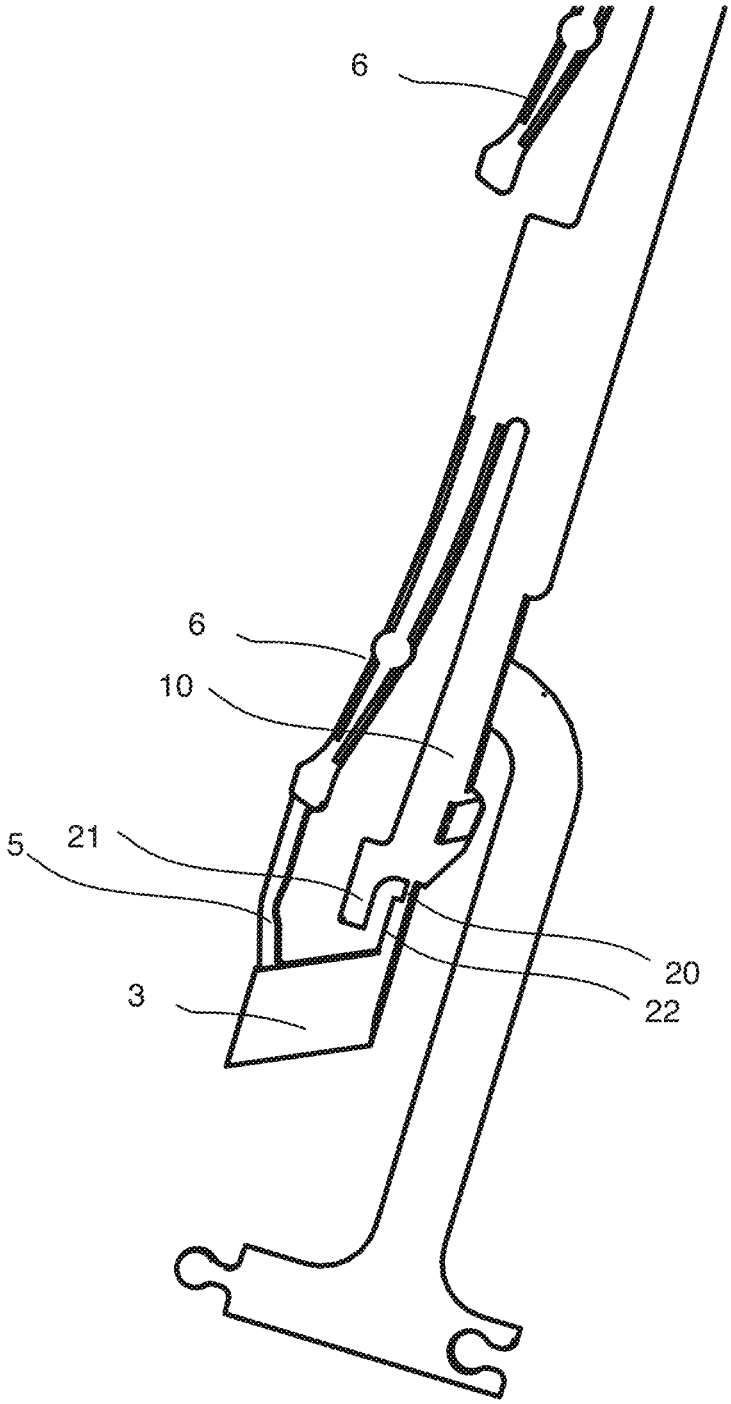
FIG. 9 shows second edge section of the third embodiment.

FIG. 9 shows the second edge 10 of the third embodiment of the tongue 1.

The third embodiment of the tongue is provided with said edge sections 3 on each edge of the tongue. Said edge section is provided with a protruding friction connection, configured to hold the tongue in the correct position until the glue is cured. A flexible link 5 connects the edge section 3 to the main tongue body.

The edge sections are each provided with an outer protruding stop part 22, which overlap an inner stop part 21, which protrudes from each edge 9, 10 of the tongue, wherein said inner and outer stop part cooperates to limit the displacement of the tongue 1 in the groove 2.

The edge sections are further provided with a breaking part 20, configured to be broken when the tongue 1 is inserted into the groove 2.

Glue may be used that glues to a wood based material and cures such that a part of the glue will form a small protrusion in the glue pocket and will connect the tongue mechanically even if the glue as such cannot glue the plastic material that is used to form the tongue.

The principles shown above may be used to connect all types of tongues that are intended to be displaceable in a groove. Even tongues that are not flexible and displaceable may be connected according to the described principles.

The invention claimed is:

1. A tongue for connection of a building panel, said tongue is of an elongated shape and made of moulded plastic, the tongue comprising at least two protrusions located at different positions along a first long edge of the tongue, wherein the protrusions are bendable in a plane parallel to the upper surface of the tongue and extend essentially in the parallel plane, wherein the tongue has a second long edge, which is essentially straight over substantially the whole length of the tongue, the tongue further comprising a gluing part configured to be glued into a groove at an edge of the building panel, wherein the gluing part comprises a gluing strip extending in the longitudinal direction of the tongue, and wherein the gluing strip is attached to outer ends of at least some of the protrusions so that there is a gap between the gluing strip and each of the protrusions in a direction extending from the first long edge to the second long edge.

2. The tongue as claimed in claim 1, where the gluing strip extends along substantially the whole length of the tongue.

3. The tongue as claimed in claim 1, wherein an outer end of a first protrusion, at a first edge of the tongue, is free and not attached to the gluing strip.

4. The tongue as claimed in claim 3, wherein an outer end of a second protrusion, at a second edge of the tongue, is attached to the gluing strip.

5. The tongue as claimed in claim 4, wherein the outer ends of the protrusions are provided with a section that is thinner than the remaining part of the protrusions for facilitating the bending of the protrusions.

6. The tongue as claimed in claim 1, wherein a protrusion is provided with a protruding friction connection, configured to hold the tongue in the correct position until the glue is cured.

7. The tongue as claimed in claim 1, wherein the tongue further comprises an edge section at a longitudinal edge of the tongue, wherein said edge section is provided with a protruding friction connection, configured to hold the tongue in the correct position until the glue is cured.

8. The tongue as claimed in claim 7, wherein the tongue is provided with said edge sections on each longitudinal edge of the tongue.

9. The tongue as claimed in claim 1, wherein an outer end of the gluing strip is provided with a bow shaped part for facilitating the insertion of the tongue into the groove.

10. The tongue as claimed in claim 1, wherein the protrusions are bow shaped.

11. The tongue as claimed in claim 1, wherein there is an angle between the protrusions and the longitudinal direction of the tongue.

12. A building panel provided with a tongue, according to claim 1, wherein said tongue is displaceable in a groove at an edge of the building panel, while also being fixed by glue in the groove.

13. The tongue as claimed in claim 1, wherein the gluing strip is attached to only the tip of at least some of the protrusions.

* * * * *